US007218050B2

(12) United States Patent
Hasegawa et al.

(10) Patent No.: US 7,218,050 B2
(45) Date of Patent: May 15, 2007

(54) PLASMA DISPLAY PANEL

(75) Inventors: Kazuyuki Hasegawa, Settsu (JP); Kaname Mizokami, Osaka (JP); Yoshinao Oe, Kyoto (JP); Masaki Aoki, Mino (JP); Junichi Hibino, Kyoto (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 161 days.

(21) Appl. No.: 10/535,823

(22) PCT Filed: Sep. 22, 2004

(86) PCT No.: PCT/JP2004/014291

§ 371 (c)(1),
(2), (4) Date: May 23, 2005

(87) PCT Pub. No.: WO2005/031783

PCT Pub. Date: Apr. 7, 2005

(65) Prior Publication Data

US 2005/0285532 A1 Dec. 29, 2005

(30) Foreign Application Priority Data

Sep. 26, 2003 (JP) ..... 2003-335272

(51) Int. Cl.
*H01J 17/49* (2006.01)
*H01J 9/00* (2006.01)
*H01J 9/24* (2006.01)

(52) U.S. Cl. ..... 313/587; 313/586; 313/582; 445/24

(58) Field of Classification Search ..... 313/582, 313/586, 587
See application file for complete search history.

(56) References Cited

U.S. PATENT DOCUMENTS

| | | | | |
|---|---|---|---|---|
| 4,529,659 | A | 7/1985 | Hoshino et al. | |
| 5,124,219 | A | 6/1992 | Shintani et al. | |
| 6,242,864 | B1 * | 6/2001 | Nakahara et al. | 313/586 |
| 2002/0121861 | A1 | 9/2002 | Katou et al. | |
| 2003/0090206 | A1 | 5/2003 | Uemura et al. | |
| 2005/0045065 | A1 * | 3/2005 | Sakurai et al. | 501/108 |
| 2005/0253519 | A1 * | 11/2005 | Hasegawa et al. | 313/587 |
| 2006/0055324 | A1 * | 3/2006 | Hasegawa et al. | 313/587 |
| 2006/0066239 | A1 * | 3/2006 | Hasegawa et al. | 313/586 |

FOREIGN PATENT DOCUMENTS

| | | |
|---|---|---|
| EP | 1 237 175 | 9/2002 |
| EP | 1 310 976 | 5/2003 |
| JP | 2000-63171 | 2/2000 |
| JP | 2003-27221 | 1/2003 |
| JP | 2003-226960 | 8/2003 |
| JP | 2003-272533 | 9/2003 |

* cited by examiner

*Primary Examiner*—Nimeshkumar D. Patel
*Assistant Examiner*—Peter Macchiarolo
(74) *Attorney, Agent, or Firm*—Wenderoth, Lind & Ponack, L.L.P.

(57) ABSTRACT

A plasma display panel includes a first substrate and a second substrate facing each other to provide a discharge space between the first substrate and the second substrate, a scan electrode and a sustain electrode both provided on the first substrate, a dielectric layer for covering the scan electrode and the sustain electrode, and a protective layer provided on the dielectric layer. The protective layer includes magnesium oxide, magnesium carbide, and silicon. This plasma display panel performs stable discharge characteristics, such as a driving voltage, thereby displaying an image stably.

9 Claims, 4 Drawing Sheets

Fig. 5

| Sample No. | Magnesium Carbide | | Concentration Of Si (ppm by wt) | Activation Energy | Flicker on Screen |
|---|---|---|---|---|---|
| | Com-position | Concentration (ppm by wt) | | | |
| 1 | $MgC_2$ | 40 | 20 | 0.24 | None |
| 2 | $MgC_2$ | 200 | 200 | 0.21 | None |
| 3 | $MgC_2$ | 1000 | 1000 | 0.21 | None |
| 4 | $MgC_2$ | 7000 | 7500 | 0.36 | None |
| 5 | $Mg_2C_3$ | 40 | 20 | 0.33 | None |
| 6 | $Mg_2C_3$ | 500 | 500 | 0.18 | None |
| 7 | $Mg_2C_3$ | 2000 | 2000 | 0.21 | None |
| 8 | $Mg_2C_3$ | 5000 | 7500 | 0.24 | None |
| 9 | $Mg_2C_3$ | 7000 | 7500 | 0.27 | None |
| 10 | $Mg_3C_4$ | 40 | 20 | 0.28 | None |
| 11 | $Mg_3C_4$ | 100 | 100 | 0.23 | None |
| 12 | $Mg_3C_4$ | 500 | 500 | 0.19 | None |
| 13 | $Mg_3C_4$ | 3000 | 3000 | 0.21 | None |
| 14 | $Mg_3C_4$ | 4000 | 7000 | 0.23 | None |
| 15 | $Mg_3C_4$ | 7000 | 7500 | 0.27 | None |
| 16 | $MgC_2$ | 5000 | 0 | 0.42 | Visible |
| 17 | $Mg_2C_3$ | 20 | 10 | 0.48 | Visible |
| 18 | $Mg_2C_3$ | 20 | 500 | 0.47 | Visible |
| 19 | None | 0 | 10 | 0.71 | Visible |
| 20 | None | 0 | 300 | 0.59 | Visible |
| 21 | None | 0 | 0 | 1 | Visible |

PLASMA DISPLAY PANEL

TECHNICAL FIELD

The present invention relates to a plasma display panel for displaying an image.

BACKGROUND OF THE INVENTION

Various types of display devices, such as a cathode ray tube (CRT), a liquid crystal display (LCD), and a plasma display panel (PDP), which are to be used for a high-definition and large display television, have been developed.

The PDP includes phosphor layers for emitting three primary colors, red (R), green (G), and blue (B) so as to perform full color display by adding and mixing three primary colors (red, green, and blue). The PDP has a discharge cell, and generates visible light by exciting phosphor layers with ultraviolet rays generated by a discharge in the discharge cell, thereby displaying an image.

In an AC type PDP, an electrode for main discharge is generally covered with a dielectric layer, and performs memory driving to reduce a driving voltage. When the dielectric layer deteriorates due to an impact of ions generated by the discharge and hitting the layer, the driving voltage may increase. To prevent this increasing, a protective layer for protecting the dielectric layer is formed on a surface of the dielectric layer. For example, a protective layer made of material having high sputtering resistance, such as magnesium oxide (MgO), is disclosed in pp. 79–80 in "ALL ABOUT PLASMA DISPLAY" co-authored by Hiraki Uchiike and Shigeo Mikoshiba, published by Kogyo Chosakai Publishing Inc. in May, 1, 1997.

The conventional PDP structured may provide the following problem. In the PDP, a pulse of a driving voltage is applied to the electrodes for generating a discharge in the discharge cell. This discharge may delay from the rising of the pulse by a period of time, "a discharge delay time". This discharge delay time may decrease a probability of end of the discharge depending on driving conditions while the pulse is applied. As a result, an electric charge may not be stored in a discharge cell to illuminate actually, thereby causing illumination failure and having quality deteriorate.

SUMMARY OF THE INVENTION

A plasma display panel includes a first substrate and a second substrate facing each other to provide a discharge space between the first substrate and the second substrate, a scan electrode and a sustain electrode both provided on the first substrate, a dielectric layer for covering the scan electrode and the sustain electrode, and a protective layer provided on the dielectric layer. The protective layer includes magnesium oxide, magnesium carbide, and silicon.

This plasma display panel performs stable discharge characteristics, such as a driving voltage, thereby displaying an image stably.

BRIEF DESCRIPTION OF THE DRAWINGS

FIG. 5 shows an evaluated result of the PDP in accordance with the embodiment.

DETAILED DESCRIPTION OF THE PREFERRED EMBODIMENT

Figure 1:
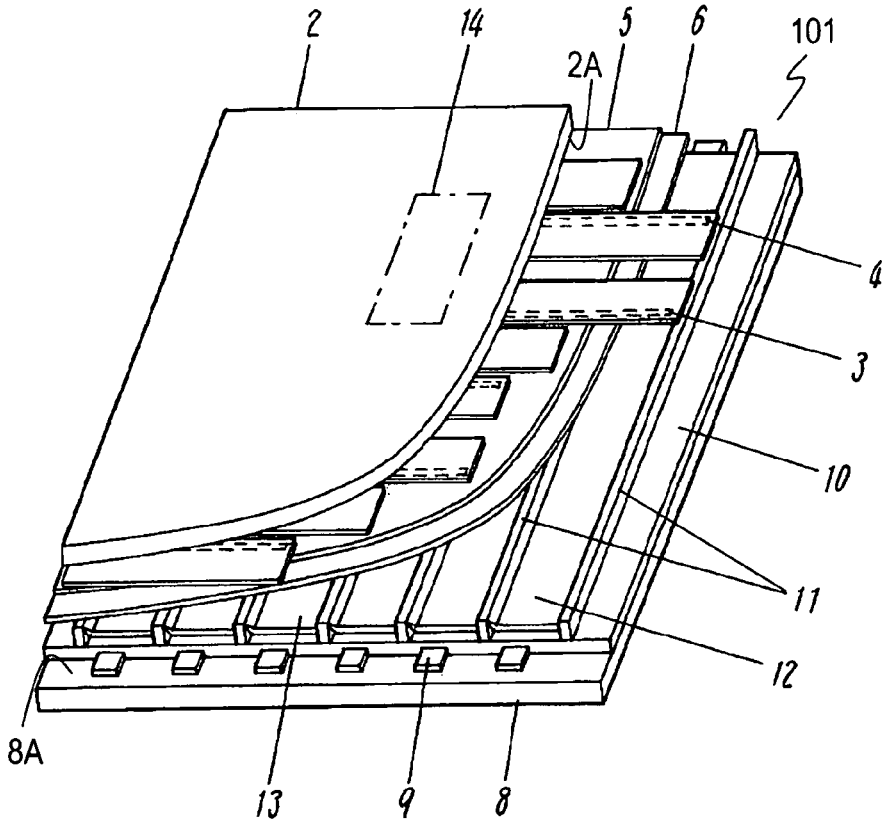
FIG. 1 is a partially-sectional, perspective view of a plasma display panel (PDP) in accordance with an exemplary embodiment of the present invention.
Figure 2:
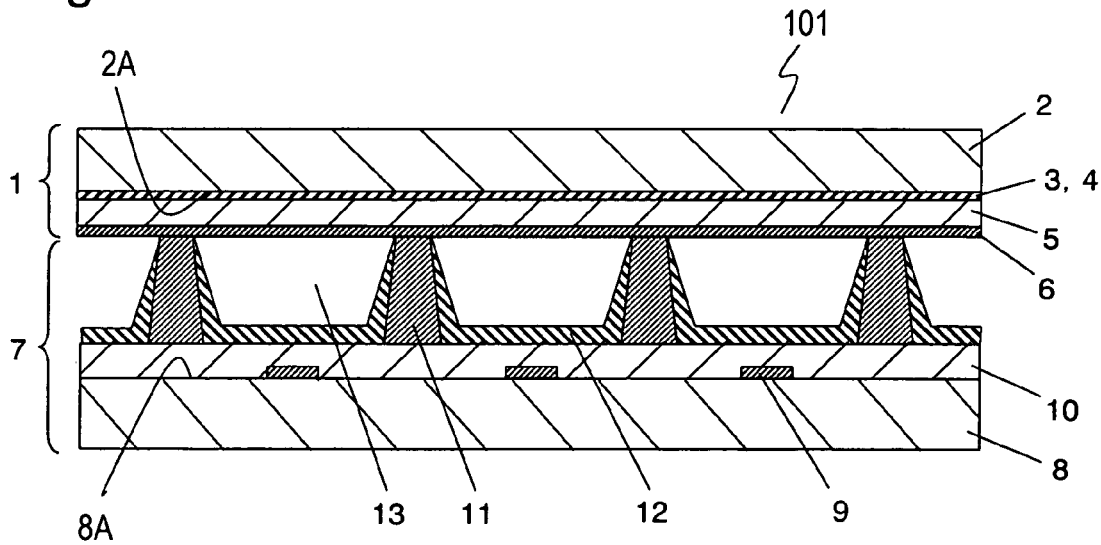
FIG. 2 is a sectional view of the PDP in accordance with the embodiment.

FIG. 1 is a partially-sectional, perspective view of an AC surface-discharge type plasma display panel (PDP) 101 for schematically illustrating a structure of the PDP. FIG. 2 is a sectional view of PDP 101.

In front panel 1, a pair of stripe scan electrode 3 and stripe sustain electrode 4 forms a display electrode. Plural pairs of scan electrode 3 and sustain electrode 4, i.e. plural of display electrodes, are provided on surface 2A of front glass substrate 2. Dielectric layer 5 covers scan electrode 3 and sustain electrode 4 is formed, and protective layer 6 for covering dielectric layer 5 is formed.

In rear panel 7, stripe address electrode 9 is provided on surface 8A of rear glass substrate 8 perpendicularly to scan electrode 3 and sustain electrode 4. Electrode protective layer 10 covering address electrode 9 protects address electrode 9, and reflects visible light in a direction towards front panel 1. Barrier ribs 11 are provided on electrode protective layer 10 and extend in the same direction as address electrode 9 and sandwich address electrode 9. Phosphor layer 12 is formed between barrier ribs 11.

Front glass substrate 2 faces rear glass substrate 8 to form discharge space 13 between the substrates. Discharge space 13 is filled with discharge gas, such as mixture rare gas of neon (Ne) and xenon (Xe), and sealed at a pressure of approximately 66500 Pa (500 Torr). Thus, an intersection between address electrode 9 and both of scan electrode 3 and sustain electrode 4 is separated by barrier ribs 11 to function as discharge cell 14, a unit emitting region. Rear glass substrate 8 is arranged apart from protective layer 6 by a predetermined distance to provide discharge space 13 between protective layer 6 and rear glass substrate 8.

In PDP 101, a driving voltage is applied to address electrode 9, scan electrode 3, and sustain electrode 4, so that discharge is generated at discharge cell 14. An ultraviolet ray generated by this discharge irradiates phosphor layer 12, and is converted into visible light to display an image.

Figure 3:
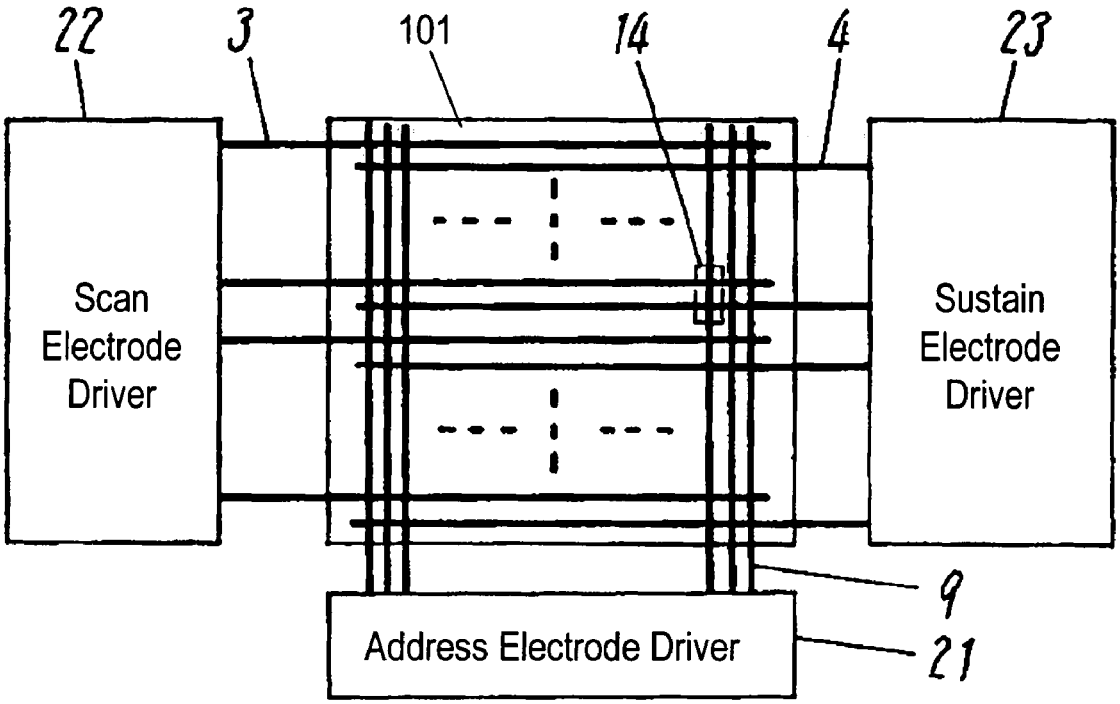
FIG. 3 is a block diagram of an image display using the PDP in accordance with the embodiment.

FIG. 3 is a block diagram of an image display including PDP 101 and a driving circuit for driving PDP 101 for schematically illustrating the display. Address-electrode driver 21 is connected to address electrode 9 of PDP 101, scan-electrode driver 22 is connected to scan electrode 3, and sustain-electrode driver 23 is connected to sustain electrode 4.

Figure 4:
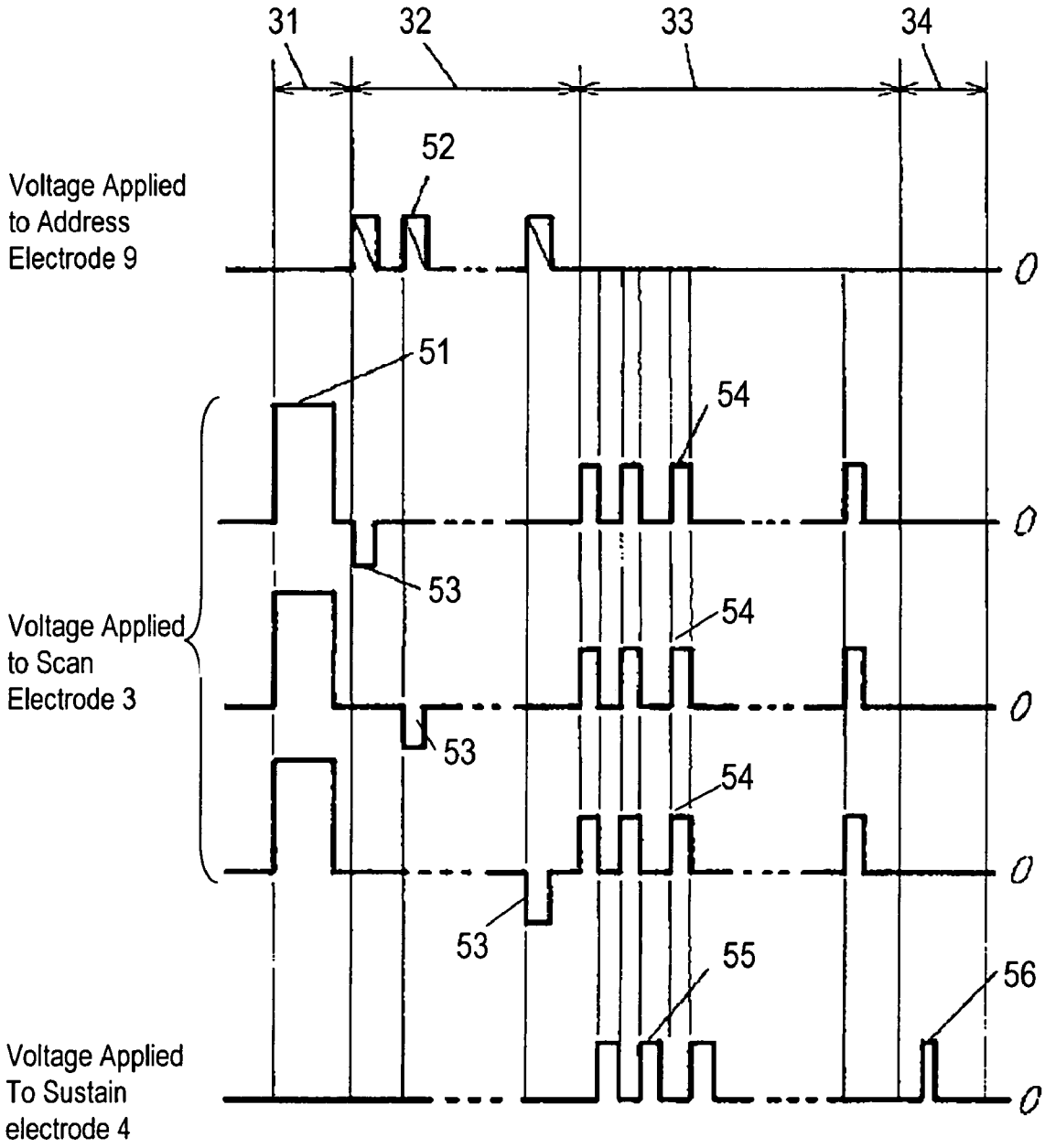
FIG. 4 is a timing chart of a driving waveform of the image display shown in FIG. 3.

In order to drive the image display using the AC surface-discharge type PDP 101, a single frame of an image is divided into plural subfields to display gradation on PDP 101. In this method, each subfield is further divided into four periods to control the discharge at discharge cell 14. FIG. 4 is a timing chart of a driving waveform in each subfield.

The timing chart of FIG. 4 shows the driving waveform of the image display shown in FIG. 3, and shows a voltage waveform applied to electrodes 3, 4 and 9 in each subfield. In setting-up period 31, initializing pulse 51 is applied to scan electrode 3 to cause all discharge cells 14 of PDP 101 to store wall electric charges for facilitating the discharge. In addressing period 32, data pulse 52 and scanning pulse 53 are applied to address electrode 9 and the scan electrode, respectively, which correspond to discharge cell 14 to illuminate. Thus, the discharge to cause discharge cell 14 to illuminate is generated. In sustaining period 33, sustain pulses 54 and 55 are applied to all scan electrodes 3 and sustain electrodes 4, respectively, so that discharge cell 14 having the discharge generated therein in addressing period 32 illuminates, and then the illumination is sustained. In erasing period 34, erasing pulse 56 is applied to sustain electrode 4, so that the wall electric charge stored in discharge cell 14 is erased to stop the illumination of discharge cell 14.

In setting-up period 31, initializing pulse 51 is applied to scan electrode 3, so that scan electrode 3 has an electric potential higher than potentials of both address electrode 9 and sustain electrode 4 to generate the discharge at each discharge cell 14. Electric charge generated by the discharge is stored on a wall of each discharge cell 14 so as to cancel a difference between the potential of address electrode 9 and the potential of each of scan electrode 3 and sustain electrode 4. Then, a negative electric charge as a wall electric charge is stored on a surface of protective layer 6 near scan electrode 3. A positive electric charge as a wall electric charge is stored on a surface of phosphor layer 12 near address electrode 9 and on a surface of protective layer 6 near sustain electrode 4. These wall electric charges provides a predetermined wall electric potential between scan electrode 3 and address electrode 9, and provides a predetermined wall electric potential between scan electrode 3 and sustain electrode 4.

In addressing period 32, scan pulses 53 are sequentially applied to scan electrodes 3, so that scan electrodes 3 have electric potentials lower than a potential of sustain electrode 4, and data pulse 52 is applied to address electrode 9 corresponding to discharge cell 14 to illuminate. At this moment, address electrode 9 has an electric potential higher than that of scan electrodes 3. That is, a voltage is applied between scan electrode 3 and address electrode 9 in the same polarity as the wall electric potential, and a voltage is applied between scan electrode 3 and sustain electrode 4 in the same polarity as the wall electric potential. These voltages generate a writing discharge at discharge cell 14. As a result, a negative electric charge is stored on a surface of phosphor layer 12 and a surface of protective layer 6 near sustain electrode 4, and a positive electric charge is stored on a surface of protective layer 6 near scan electrode 3. Thus, a predetermined wall electric potential is generated between sustain electrode 4 and scan electrode 3.

The writing discharge delayed by a discharge delay time after scan pulse 53 and data pulse 52 are applied to scan electrodes 3 and address electrode 9, respectively. If the discharge delay time is long, the writing discharge may not be generated in a period (addressing period) during which scan pulse 53 and data pulse 52 are applied to scan electrodes 3 and address electrode 9, respectively. At discharge cell 14 in which the writing discharge is not generated, even when sustain pulses 54 and 55 are applied to scan electrodes 3 and sustain electrode 4, the discharge is not generated, and phosphor layer 12 does not emit light, thus adversely affecting the image display. PDP 101, performing high resolution display, the addressing period assigned to scan electrode 3 becomes short, so that a probability that writing discharge is not generated becomes high. Furthermore, if the partial pressure of Xe in the discharge gas is not lower than 5%, the probability that the writing discharge is not generated becomes high. In addition, if barrier ribs 11 are not formed as stripe patterns shown in FIG. 1 but as a mesh pattern surrounding discharge cell 14, the probability that the writing discharge is not generated becomes high even in the case that a lot of the impurity gases remains.

In sustaining period 33, sustain pulse 54 is applied to scan electrodes 3 so that scan electrode 3 has an electric potential higher than that of sustain electrode 4. That is, a voltage is applied between sustain electrode 4 and scan electrode 3 in the same polarity as the wall electric potential generate a sustain discharge. As a result, discharge cell 14 can start illuminating. Sustain pulses 54 and 55 are applied to change respective polarities of sustain electrode 4 and scan electrode 3 alternately, thereby generating pulse emission intermittently in discharge cell 14.

In erasing period 34, narrow erasing pulse 56 is applied to sustain electrode 4 generate an insufficient discharge, thereby erasing the wall electric charge.

Protective layer 6 of PDP 101 of the embodiment will be described below.

Protective layer 6 is made of magnesium oxide (MgO) including silicon (Si) and magnesium carbide, such as $MgC_2$, $Mg_2C_3$, and $Mg_3C_4$. Protective layer 6 is formed by providing an evaporation source including MgO, silicon, and magnesium carbide, such as $MgC_2$, $Mg_2C_3$, $Mg_3C_4$, heating the evaporation source is heated by a heating device, such as a Pierce type electron beam gun, in oxygen atmosphere, and depositing the heated source on dielectric layer 5.

PDP 101 includes protective layer 6 discussed above. Protective layer 6 prevents an error that a writing discharge is not generated since shortening a discharge delay time in addressing period 32 for the following reason.

A conventional protective layer includes highly-pure, about 99.99% of MgO provided by a vacuum evaporation method (EB method), hence having a small electronegativity and a large ionicity. Therefore, Mg ion at a surface of the protective layer is unstable (in a high-energy state), hence adsorbing hydroxyl group (OH group) to be stable. (For example, see "COLOR MATERIAL" 69(9), 1996, pp. 623–631.) According to cathode luminescence analysis, it is confirmed that peaks of cathode luminescence caused by a lot of oxygen defects appears. The conventional protective layer has a lot of defects which adsorb impurity gas, such as $H_2O$, $CO_2$, and hydrocarbon (CHx). (For example, see documents of Discharge Research Institute at Institute of Electrical Engineers of Japan EP-98–202, 1988, p. 21).

A main cause of the delay of the discharge delaying may be that a primary electron serving as a trigger for starting the discharge is hardly emit from the protective layer to the discharge space.

Magnesium carbide, such as $MgC_2$, $Mg_2C_3$, or $Mg_3C_4$, and silicon is added to protective layer 6 of MgO. This addition changes a distribution of oxygen defects in MgO crystal, thereby preventing the discharge delay and writing errors.

In a process for forming protective layer 6, conditions, such as the value of an electron beam current, a partial pressure of oxygen, a temperature of substrate 2, do not affect the composition of protective layer 6 much, hence being determined arbitrarily. For example, a vacuum degree may be set to a value not higher than $5.0\times10^{-4}$ Pa, the temperature of substrate 2 may be set to a value not lower than 200° C., and a pressure for vapor deposition may be set to a value ranging from $3.0\times10^{-2}$ Pa to $8.0\times10^{-2}$ Pa.

A method of forming protective layer 6 is not limited to the vapor deposition mentioned above, but may be employ a sputtering method or an ion plating method. The sputtering method would employ a target formed by sintering MgO powder in air, and the target may include silicon and magnesium carbide, such as $MgC_2$, $Mg_2C_3$, or $Mg_3C_4$. The ion plating method would employ the evaporation source mentioned above for the vapor deposition method.

MgO, the magnesium carbide, such as $MgC_2$, $Mg_2C_3$, or $Mg_3C_4$, and silicon are not necessarily mixed previously as materials. Protective layer 6 may be formed by preparing separate targets or evaporation sources and then mixing the materials evaporated.

Next, a method of manufacturing PDP 101 of the embodiment will be described below. First, a method of manufacturing front panel 1 will be described.

Scan electrode 3 and sustain electrode 4 are formed on front glass substrate 2, and covered with lead-base dielectric layer 5. Protective layer 6 including MgO, silicon, and the magnesium carbide, such as $MgC_2$, $Mg_2C_3$, or $Mg_3C_4$ is formed on a surface of dielectric layer 5, thus providing front panel 1.

In PDP 101 according to the embodiment, each of scan electrode 3 and sustain electrode 4 may include a transparent electrode and a silver electrode as a bus electrode formed on the transparent electrode. The transparent electrode is formed to have a stripe shape by a photolithography method, and the silver electrode is formed on the transparent electrode by a photolithography method. Then, these electrodes are baked.

Lead-based dielectric layer 5 has its composition of, for example, 75 wt. % of lead oxide (PbO), 15 wt. % of boron oxide ($B_2O_3$), and 10 wt. % of silicon oxide ($SiO_2$). Dielectric layer 5 is formed by, for example, screen printing and baking.

Protective layer 6 is formed by the vacuum deposition method, the sputtering method, or the ion plating method.

In order to form protective layer 6 by the sputtering method, the target including MgO and additive including 40 ppm by weight to 7000 ppm by weight of magnesium carbide, such as $MgC_2$, $Mg_2C_3$, or $Mg_3C_4$, and 20 ppm by weight to 7500 ppm by weight of silicon is sputtered in sputtering gas, such as Ar gas, and reaction gas, such as oxygen gas ($O_2$ gas), thereby providing protective layer 6. In this sputtering, while front glass substrate 2 is heated at a predetermined temperature (200° C.–400° C.), Ar gas and $O_2$ gas (if necessary) is put into a sputtering apparatus depressurized within a range from 0.1 Pa to 10 Pa by an exhausting apparatus, thereby providing protective layer 6. In order to facilitate adding the additive, simultaneously to the sputtering, while an electric potential ranging from −100V to 150V is applied to front glass substrate 2 by a bias supply, the target is sputtered to form protective layer 6. This process further improves its characteristics. The amount of the additive to be put into MgO is controlled by the amount of the additive in the target and a high-frequency electric power for generating discharge for the sputtering.

In the case that protective layer 6 is formed by the vacuum deposition method, front glass substrate 2 is heated at 200° C.–400° C., and a deposition chamber is depressurized at $3\times10^{-4}$ Pa by an exhausting apparatus. A predetermined number of evaporation sources of hollow cathodes and an electron beam is set in the chamber as to evaporate MgO and the additive added to MgO. Then, these materials are deposited on protective layer 6 with using reaction gas, such as oxygen gas ($O_2$ gas). According to the embodiment, while $O_2$ gas is put into the deposition chamber depressurized within a range from 0.01 Pa to 1.0 Pa by the exhausting system. Then, MgO and the additive, i.e., 40 ppm by weight to 7000 ppm of magnesium carbide, such as $MgC_2$, $Mg_2C_3$, or $Mg_3C_4$, and 20 ppm by weight to 7500 ppm by weight of silicon are evaporated by the electron beam or the evaporation source of the hollow cathode, thereby providing protective layer 6 on dielectric layer 5.

Next, a method of manufacturing rear panel 7 will be described below.

Silver-based paste is applied on rear glass substrate 8 by screen printing and then is baked to provide address electrode 9. Lead-based dielectric layer 18 for protecting the electrode is formed on address electrode 9 by screen printing, and is baked similarly to front panel 1. Barrier ribs 11 made of glass are provided at predetermined pitches and fixed. One of red phosphor, green phosphor and blue phosphor is provided in a space surrounded by barrier ribs 11, thus providing phosphor layer 12. In the case that barrier ribs are provided to form a mesh pattern surrounding discharge cell 14, another barrier rib is formed perpendicularly to barrier rib 11 shown in FIG. 1.

The phosphors in above may employ phosphors generally in PDPs, such as:

Red phosphor: $(Y_xGd_{1-x})BO_3$:Eu

Green phosphor: $Zn_2SiO_4$:Mn, (Y, Gd)$BO_3$:Tb

Blue phosphor: $BaMgAl_{10}O_{17}$:Eu

Front panel 1 and rear panel 7 manufactured by the above mothod are bonded with each other with sealing glass so that scan electrode 3 and sustain electrode 4 face address electrode 9 perpendicularly to address electrode 9. Then, discharge space 13 partitioned by barrier ribs 11 is exhausted to high vacuum (e.g. $3\times10^{-4}$ Pa) as exhausting baking. Then, the discharge gas having a predetermined composition is put into discharge space 13 at a predetermined pressure, hence providing PDP 101.

PDP 101, being used for 40-inch class hi-definition TV, has discharge cells 14 having small sizes and arranged by a small pitch, and therefore, may preferably includes the barrier ribs arranged in the mesh pattern to increase brightness.

The composition of the filling discharge gas may be of Ne—Xe-based. The partial pressure of Xe may be preferably determined to be not lower than 5%, and the pressure of the discharge gas may be preferably determined to be within 450–760 Torr to increase a brightness of the discharge cell.

Samples of the PDP manufactured by the above method were prepared and evaluated for evaluating performance of the PDP according to the present embodiment.

Plural kinds of evaporation sources, i.e., materials of protective layer 6 including magnesium carbide, such as $MgC_2$, having its concentration ranging from 0 ppm by weight to 7000 ppm by weight and silicon having its concentration ranging from 0 ppm by weight to 7500 ppm by weight both added to MgO were prepared. Plural kinds of front panels including the protective layers formed by using these evaporation sources were manufactured. Then, samples of the PDP were prepared by using these materials. The samples of the PDP were measured in discharge delay time under atmospheric temperatures ranging from −5° C. to 80° C. According to results of this measurement, an Arrhenius plot of the discharge delay time to the temperatures was produced, and then, activation energy in the discharge delay time was obtained from an approximate straight line of the plot. Discharge gas filling in the sample is mixture gas of Ne—Xe, and the partial pressure of Xe was 5%.

The discharge delaying time here is a period of time from the time a voltage is applied between scan electrode 3 and address electrode 9 to the time the discharge (writing discharge) occurs. The time illumination caused by the writing discharge exhibits a peak is regarded as the time when the writing discharge occurs. A period of time from the time a pulse is applied to an electrode of each sample till the time when the writing discharge occurs was measured 100 times and averaged, thus providing the discharge delay time.

The activation energy is a value showing characteristics, such as a variation of the discharge delay time against temperatures. It is considered that the lower the value of activation energy is, the less the characteristics change against the temperatures.

FIG. 5 shows the concentrations of silicon and magnesium carbide both added to the evaporation source of MgO as material of protective layer 6, the activation energy of the samples of the PDP including protective layer 6 formed by using the evaporation sources, and a status of illumination (whether flicker was observed or not) of the samples of the PDP. Regarding the flicker, "visible" shown in FIG. 5 represents the case that the flicker is visible when the samples of the PDP operates while changing an atmospheric temperature from −5° C. to 80° C. In FIG. 5, activation energy of a sample (sample No. 21) of a conventional panel having a protective layer by using the evaporation source including made of MgO with no additive is expressed as "1", and activation energy of each sample is expressed as a value relative to the sample of the conventional panel.

Each sample including the concentration of magnesium carbide in the evaporation source of MgO larger than 7000 ppm by weight and the concentration of silicon larger than 7500 ppm by weight exhibited a long discharge delay time, or required an extremely-high voltage to produce the discharge, thereby not being able to display an image with a conventional voltage. Samples Nos. 1–20 have activation energy smaller than activation energy of the conventional sample, however, samples Nos. 16–20 exhibited flickers. As shown in FIG. 5, the flicker did not occur in each sample provided by using the evaporation source of MgO including 40 ppm by weight to 7000 ppm by weight of magnesium carbide and 20 ppm by weight to 7500 ppm by weight of silicon. Protective layer 6 including silicon has electron-emission ability better than that of the conventional sample.

A high partial pressure of Xe in the discharge gas tends to increase a variation of the discharge delay time against a temperature, thus causing the temperature to affect operating and displaying characteristics of the PDP. For this reason, a small activation energy shown in FIG. 5 is preferable. Relative values of the activation energy of samples Nos. 1–15 are extremely low. For this reason, even if the Ne—Xe discharge gas includes a high partial pressure, 10%–50%, of Xe, samples including protective layer 6 formed by using the evaporation source of MgO including 40 ppm by weight to 7000 ppm by weight of magnesium carbide and 20 ppm by weight to 7500 ppm by weight of silicon had small flicker due to temperature characteristics of the discharge delay time, thus preferably displaying images.

Protective layer 6 formed by using the evaporation source of MgO including 40 ppm by weight to 7000 ppm by weight of magnesium carbide and 20 ppm by weight to 7500 ppm by weight of silicon is made of magnesium oxide including 40 ppm by weight to 7000 ppm by weight of magnesium carbide and 20 ppm by weight to 7500 ppm by weight of silicon. Even if the partial pressure of Xe in the discharge gas is not lower than 10%, the samples of the PDP including protective layer 6 display images without changing voltages applied to electrodes from conventional voltage values, and reduce a variation of the discharge delay time against temperature.

It is considered that the additive of magnesium carbide, such as $MgC_2$ or $Mg_2C_3$, and silicon (Si) added into magnesium oxide (MgO) changes the concentration or distribution of oxygen defects in crystals of MgO. Thereby, factors increasing variation of characteristics against temperature are eliminated, thus reducing the variation of characteristics against temperature.

The protective layer made of MgO, magnesium carbide, and Si, shortens the discharge delay time, and accordingly reduces a variation of the discharge delay time against temperature. Thus, the protective layer has excellent electron emission ability hardly changing against temperature. This allows PDP 101 according to the embodiment to preferably display images regardless of environmental temperature.

According to the embodiment, the magnesium carbide is $MgC_2$, $Mg_2C_3$, or $Mg_3C_4$, and may be mixture of, for example, $MgC_2$ and $Mg_2C_3$. That is, the protective layer may include at least one of $MgC_2$, $Mg_2C_3$, and $Mg_3C_4$ as the magnesium carbide. In this case, the total amount of the magnesium carbide ranges from 40 ppm by weight to 7000 ppm by weight, providing the same effect.

INDUSTRIAL APPLICABILITY

A plasma display panel of the present invention has stable discharge characteristics, such as a driving voltage, and displays an image stably.

The invention claimed is:

1. A plasma display panel comprising:

a first substrate and a second substrate facing each other to provide a discharge space between the first substrate and the second substrate;

a scan electrode and a sustain electrode both provided on the first substrate;

a dielectric layer for covering the scan electrode and the sustain electrode; and a protective layer provided on the dielectric layer, the protective layer including magnesium oxide, magnesium carbide, and silicon.

2. The plasma display panel of claim 1, wherein the protective layer includes 40 ppm by weight to 7000 ppm by weight of magnesium carbide and 20 ppm by weight to 7500 ppm by weight of silicon.

3. The plasma display panel of claim 1, wherein the magnesium carbide of the protective layer comprises at least one of $MgC_2$, $Mg_2C_3$ and $Mg_3C_4$.

4. A method of manufacturing a plasma display panel, comprising:

forming a scan electrode and a sustain electrode on a first substrate;

forming a dielectric layer for covering the scan electrode and the sustain electrode;

forming a protective layer on the dielectric layer by using material including magnesium oxide, magnesium carbide, and silicon; and providing a second substrate apart from the protective layer by a predetermined distance so as to provide a discharge space between the protective layer and the second substrate.

5. The method of claim 4, wherein the material of the protective layer includes 40 ppm by weight to 7000 ppm by weight of magnesium carbide and 20 ppm by weight to 7500 ppm by weight of silicon.

6. The method of claim 4, wherein the magnesium carbide of the material of the protective layer comprises at least one of $MgC_2$, $Mg_2C_3$, and $Mg_3C_4$.

7. A method of manufacturing a plasma display panel comprising:

forming a scan electrode and a sustain electrode on a first substrate;

forming a dielectric layer for covering the scan electrode and the sustain electrode;

forming a protective layer comprising magnesium oxide, magnesium carbide, and silicon, on the dielectric layer; and providing a second substrate apart from the protective layer by a predetermined distance to provide a discharge space between the protective layer and the second substrate.

8. The material of claim 7, comprising 40 ppm by weight to 7000 ppm by weight of the magnesium carbide and 20 ppm by weight to 7500 ppm by weight of the silicon.

9. The material of claim 7, wherein the magnesium carbide comprises at least one of $MgC_2$, $Mg_2C_3$ and $Mg_3C_4$.

* * * * *

UNITED STATES PATENT AND TRADEMARK OFFICE

CERTIFICATE OF CORRECTION

PATENT NO. : 7,218,050 B2
APPLICATION NO. : 10/535823
DATED : May 15, 2007
INVENTOR(S) : Kazuyuki Hasegawa et al.

It is certified that error appears in the above-identified patent and that said Letters Patent is hereby corrected as shown below:

ON THE TITLE PAGE

Item (57), Abstract, lines 10-11, "thereby displaying an image stably" should read --thereby stably displaying an image--.

Signed and Sealed this

Sixth Day of November, 2007

JON W. DUDAS
*Director of the United States Patent and Trademark Office*